United States Patent [19]

Clausing et al.

[11] Patent Number: 4,475,732

[45] Date of Patent: Oct. 9, 1984

[54] SHEET FEEDING AND SEPARATING APPARATUS WITH STACK FORCE RELIEF/ENHANCEMENT

[75] Inventors: Don P. Clausing, Rochester; Maurice F. Holmes, Brighton; Raymond A. Povio, Pittsford; Robert P. Rebres, Fairport, all of N.Y.

[73] Assignee: Xerox Corporation, Stamford, Conn.

[21] Appl. No.: 420,966

[22] Filed: Sep. 21, 1982

[51] Int. Cl.[3] ..... B65H 5/02

[52] U.S. Cl. ..... 271/10; 221/259; 271/34; 271/118; 271/125

[58] Field of Search ..... 271/34, 10, 35, 117, 271/118, 121, 122, 125; 221/259

[56] References Cited

U.S. PATENT DOCUMENTS

| | | | |
|---|---|---|---|
| 3,272,500 | 9/1966 | Van Dalen et al. . | |
| 3,469,834 | 9/1979 | Stange et al. | 271/10 |
| 3,768,803 | 10/1973 | Stange et al. | 271/34 |
| 3,934,869 | 1/1976 | Strobel | 271/35 |
| 4,033,578 | 7/1977 | Taylor et al. | 271/34 |
| 4,203,586 | 5/1980 | Hoyer | 271/34 |
| 4,397,455 | 8/1983 | Hickey | 271/34 |

OTHER PUBLICATIONS

IBM Technical Disclosure Bulletin, "Document Feed Interrupt", R. G. Hart and W. B. Plummer, vol. 8, No. 10, Mar. 1966, p. 1423.

*Primary Examiner*—Bruce H. Stoner, Jr.
*Assistant Examiner*—John A. Carroll
*Attorney, Agent, or Firm*—William A. Henry, II

[57] ABSTRACT

A retard feeder and separator apparatus adapted to sense the threat of a misfeed or multifeed and adjust the stack normal force of a feed belt against a stack of sheets accordingly. The apparatus includes a movable frame on which is mounted a sheet separating feed belt, a retard roll that forms a retard nip with the separating feed belt, and a stack force relief sensor. The sensor detects the lead edge of a sheet fed from a stack as it reaches the retard nip and causes a solenoid connected to the frame to trigger and move the frame slightly. The frame movement relieves the stack normal force of the feed belt against the stack from a high value to a low value while the sheet continues to be fed from the stack by the force in the retard nip and the lessened stack normal force. Alternatively, if the sensor does not sense a sheet within a predetermined period of time, the stack normal force will be increased to the original high value.

2 Claims, 5 Drawing Figures

SHEET FEEDING AND SEPARATING APPARATUS WITH STACK FORCE RELIEF/ENHANCEMENT

Cross reference is made to the following applications by the same assignee having the same filing date: U.S. application Ser. No. 420,964 by Don P. Clausing and U.S. application Ser. No. 421,018 by Raymond A. Povio and Robert P. Rebres.

This invention relates to a sheet feeding and separating apparatus for feeding individual sheets from a stack and more particularly to sheet feeding and separating apparatus that employs stack force relief or enhancement in order to feed a wide latitude of sheets.

A major problem associated with sheet feed devices is in feeding papers of varying weights, curl conditions and surface characteristics. With the advent of high speed reproduction machines, the need for sheet feeders to handle a wide variety of sheets without misfeed or multifeed is paramount. However, most sheet feed devices are designed specifically for a particular type or weight of paper having known characteristics. Thus, for example, for feeding virgin sheets upon which copies are to be made into a reproduction machine, the sheet feeders are usually designed specifically for a certain copy paper characteristic. However, in practice, the machine will be exposed to a wide variety of sheets ranging from extremely heavy paper (110 lb. card stock) all the way to onion skin (9 lb. or 8 lb. bond). If a feeder is designed to handle the lightest weight paper that may be encountered, in all probability it will not feed heavy stock paper reliably. At the other extreme, if a feeder is designed to handle heavy weight paper there is a possibility that the feeder would severely mulitlate light weight paper such as onion skin.

Light weight sheets having a low intersheet frictional characteristic require a very small force to separate individual sheets from a stack. Further, the retard force necessary to minimize the possibility of a multifeed may also be very low. At the opposite extreme, a great deal of force may be extended on heavy weight paper or paper having large values and large variations of intersheet frictional characteristics and a retard force necessary to prevent multifeeds must also be fairly high. Also, curl reduces buckle strength of sheets and as a result of this reduced force, prior friction retard feeders have not been satisfactory in feeding a wide variety of sheets.

The present invention overcomes the above-mentioned difficulties by employing a retard feeder and separator apparatus that senses the threat of a misfeed or multifeed and adjusts the stack normal force of a feed member against a stack of sheets.

A preferred feature of the present invention is to provide a feed means and retard separator that is mounted on a movable frame and located downstream from a sheet feeding area. A sensor detects the lead edge of a sheet fed from a stack as it reaches the retard nip and causes an actuator connected to the frame to pull against the frame and thereby rebalance the feed means. The stack normal force is thereby reduced while the sheet continues to be fed from the stack by the force in the retard nip and by the lower value of stack normal force. Alternatively, if the sensor does not sense a sheet by a predetermined time, the stack normal force will be maintained at the high level.

Other features and aspects of the present invention will be apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
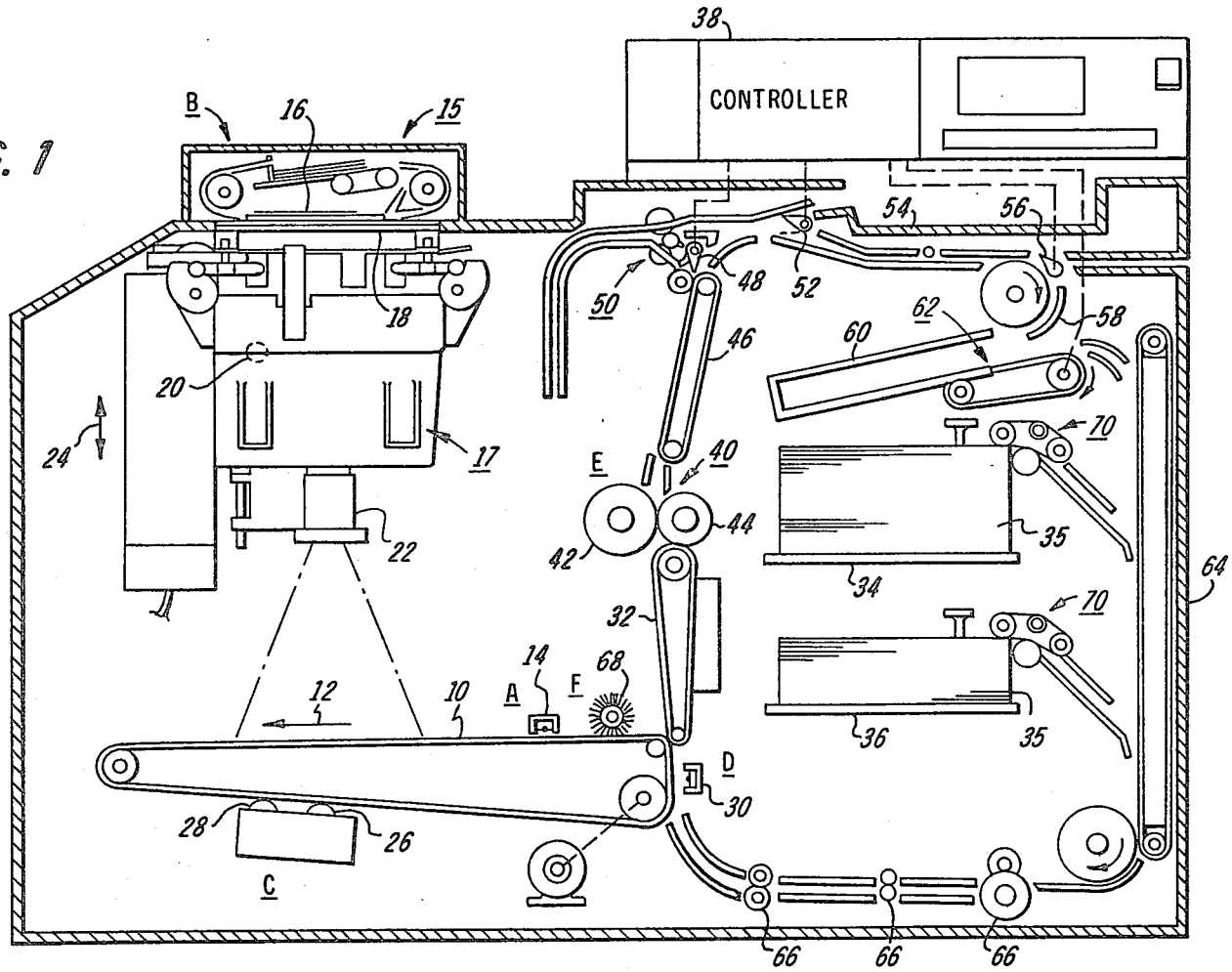
FIG. 1 is a schematic elevational view showing an electrophotographic printing machine employing the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the sheet feeding and separating apparatus of the present invention therein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movable and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a printing machine which does not include a document handling unit.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developd, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from a selected one of trays 34 or 36 to transfer station D. Each of these trays sense the size of the copy sheet and send an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed seriatim by bottom feeder 62 back to transfer station D for transfer of the toner powder image to the opposed side of the sheet. Conveyors 64 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostaic charge remaining thereon prior to the charging thereof for the next successive imaging cycle.

Figure 2:
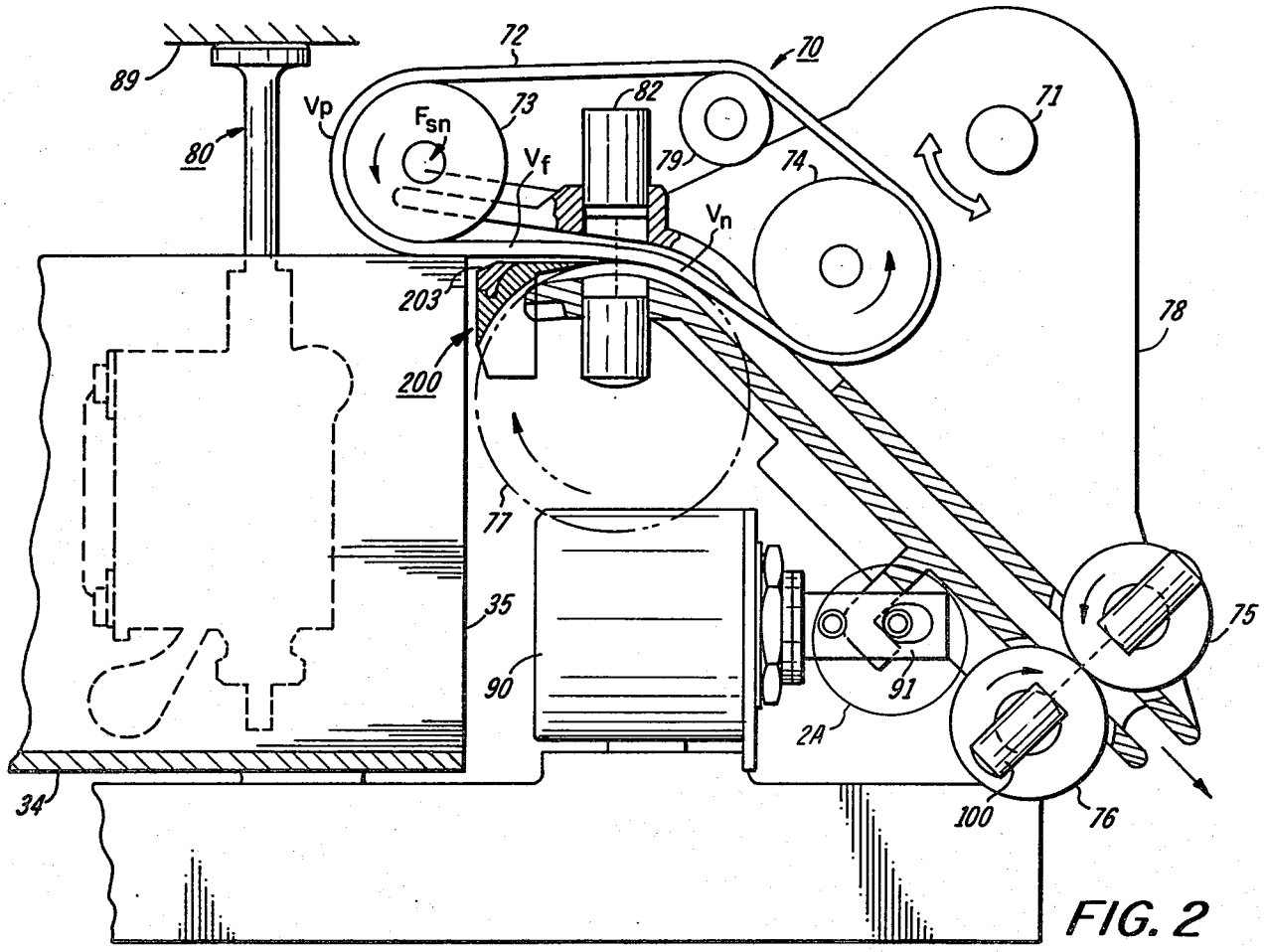
FIG. 2 is a schematic elevational view depicting the sheet feeding and separating apparatus of the present invention used in the FIG. 1 printing machine.

Turning now to an aspect of the present invention, a sheet separation and feeding apparatus is shown in FIG. 2 that employs a feed head mechanism 70 shown in FIG. 2 which pivots about the feed head pivot point 71. The feed head 70 includes everything shown except the paper stack 35 and the abutment for sensor 80. The dynamic stack normal force is shown as $F_{sn}$. This is a force applied to the paper stack 35 by feed belt 72 due to the feed head balancing around the pivot point 71 and the effect of drive torques supplied to the feed head through the pivot point. Belt drives (now shown) transfer power to the feed belt 72 and take-away rolls 75 and 76.

The normal force between the feeding component and the stack is a critical parameter. If $F_{sn}$ is too large, multifeeding and sheet damage will occur. If $F_{sn}$ is too small, misfeeding will occur. In some feeders, such as the present, the sheet is fed to a separation station. Once the sheet is in the separation station, it no longer has to be driven by the original value of stack normal force. At this point, it is advantageous to reduce the stack normal force in order to reduce the tendency to drive a second sheet through the separation station formed between feed belt 72 and retard roll 77. To accomplish this end result, a sensor 82 is shown in FIG. 2 which senses the presence of a sheet in the separation station and causes the stack normal force to be reduced through means to be described hereinafter. Reducing $F_{sn}$ also reduces compression forces in the sheet thereby reducing sheet damage tendencies. This is especially important when feeding lightweight, curled sheets.

The retard separation mechanism 70 is mounted on a frame 78 that is pivoted about axis 71. When sensor 82 detects the lead edge of a sheet at or near the retard nip formed between belt 72 and retard roller 77, controller 38 actuates solenoid 90 which through retracting plunger 91 pivots frame 78 about axis 71 slightly and, as a result, decreases the normal force of the feed member against the stack. The stack normal force could be reduced to zero or lifted completely off the stack if desired, however, for optimum results, the stack normal force is reduced from 0.5 to 0.1 lb. The force in the retard nip along with the reduced normal force will cause the belt to drive the first sheet through the nip and into the take-away rolls 75 and 76. Because the stack normal force has been reduced, i.e., stack force relief has been applied, it should not contribute enough drive force to the second sheet to drive it through the nip, thus reducing the probability of a multifeed. Conversely, if the stack normal force has been reduced and sensor 82 does not detect a sheet every 0.3 sec., the controller will deactuate solenoid 90 causing the feed head to assume its original position and stack normal force value thereby increasing the stack normal force to 0.5 lb. in order to feed a sheet from the stack, i.e., the stack force is enhanced. The term sheet is used herein to mean substrates of any kind.

This feeder employs independent drives for the feed belt 72 through drive roll 74 and take-away rolls 75 and 76 through drive roll 75. With roll 75 as the drive roll, one clutch is used to drive the feed belt and one clutch to drive the take-away rolls. A wait sensor 100 is stationed at the take-away rolls, i.e., away from the retard roll nip. Only one clutch pulse per sheet is required with this two clutch approach as opposed to a one clutch approach that would require one clutch pulse to bring a sheet to the wait sensor which would be placed on the retard roll side of the take-away rolls and a second clutch pulse to drive the sheet into the take-away rolls. An early feed belt restart logic is used with this independent drive system. The logic restarts the feed belt (after wait time has elapsed) as soon as there is no paper at the stack normal force relief sensor 82 or as soon as there is no paper at the wait sensor 100, whichever occurs first. The wait sensor is also used as a jam detector.

In friction retard head 70 sheets are fed forward by the feed belt 72. When more than one sheet is fed from the stack, entrance guide 200 comes into play. The guide which is located between the means 72 and retard roll means 77, contributes to the feeder's ability to handle a wide variety of sheets and avoid failure due to misfeeding or sheet damage by performing a gating function with a beveled edge 203 to break up slugs of sheets and also serves to support sheets from the stack into the retard roll. Sheets other than the one to be fed are held back by the top frictional surface of the guide and the retard roll 77. The feed belt to paper friction is normally higher than the retard roll to paper friction and retard roll to paper friction is higher than paper to paper friction. While feed belt 72 and retard roll 77 are shown in the disclosed embodiment of the present invention, it should be understood that a different feed means, such as, a roll, paddle wheel, etc., could replace the belt and be used together with a dual roll retard nip if one desired.

The paper feeders 34 and 36 have a drag brake controlled retard roll 77. This is an unusual retard feeder characteristic. The retard brake torque and other feed head critical parameters are selected so that with one sheet of paper through the retard nip the retard roll rotates in the feed direction and with two sheets of paper through the retard nip the roll is fixed.

Turning to the feed belt and its variation of surface speed at various locations, the pick off idler feed belt surface speed $V_p$ is > the free span surface speed $V_f$ > the nip surface speed $V_n$. This is due to feed belt 72 bending around the pick off idler pulley 73 and retard roll 77 in opposite directions. At one location in the belt thickness, the neutral axis (N.A.), the speed is equal to the $V_f$ value throughout the belt path. As the belt is bent around a pulley as at the pick off idler 73 the surface speed increases since the surface here is stretched relative to the N.A. Similarly, the surface is compressed as the belt is bent around the retard roll relative to the N.A. and the surface speed decreases.

What happens to a sheet of paper which is being driven by both the feed belt at the pick off idler and in the retard nip should be considered when examining how the present feeder performs. The feed belt surface speed at the idler is > the surface speed in the nip, so the portion of the sheet at the idler is driven so as to overtake the portion of the sheet in the nip. If the stack and nip normal forces are large enough, the feed belt friction is large enough, the paper is weak enough, sheets will buckle and jam. Normal feeder operating conditions without stack force relief(SRF), when feeding 13 lb. bond paper, lead to paper jams of this type.

Now, lets review how the feeder of the present invention operates with SFR (stack force relief) acting. When paper is present at SFR sensor 82 the $F_{sn}$ value is controlled to a low value. When no paper is present at the SFR sensor the $F_{sn}$ value is increased. The high value of $F_{sn}$ is defined so that the most difficult paper will feed reliably, i.e., not misfeed. The low value of $F_{sn}$ is defined so that the lightest weight sheets will not be damaged with it acting. The high and low values of $F_{sn}$ are independent. Sheet buckling could occur whenever the paper is being driven by both the pick off idler 73 and feed retard nip 72, 77. However, whenever that condition exists there is paper present at the SFR sensor and the feed belt to sheet coupling at the pick off idler 73 is inadequate to cause lightweight sheet buckling, therefore, light weight sheet buckling will not occur. It would appear that one could simply select a lower value of $F_{sn}$ and not use SFR. However, the value of $F_{sn}$ which avoids buckling light weight sheets (13 lb. bond) is too small for reliable heavy weight sheet (110 lb.) feeding.

There are other system impacts associated with using SFR. These relate to reducing multifeed failures and extending the life of a retard brake located within retard roll 77. Classic slug multifeeds are caused by an unfavorable sheet two force balance during the time a sheet lead edge is being fed through the retard nip. If the sheet two force balance is in the feed direction, the sheet multifeeds. One critical value in the sheet two force balance equation is the stack normal force $F_{sn}$. The higher the value of $F_{sn}$ the greater the multifeed potential becomes. Reducing $F_{sn}$ reduces the multifeed rate.

The torque applied to the retard brake with two sheets through the retard nip depends on many factors, including dynamic feed belt tension. Dynamic feed belt tension is increased by increases in dynamic stack normal force $F_{sn}$. So smaller values of $F_{sn}$ give smaller torques applied to the retard roll. When the two sheets through applied torque exceeds the retard brake torque, a multifeed results. As the brake is used by repeated sheet feeds, its available torque is reduced. So reducing $F_{sn}$ extends brake life.

Figure 2A:
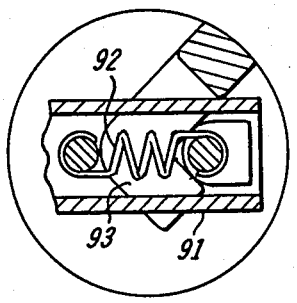
FIG. 2A is a schematic elevational view illustrating the spring employed in a solenoid member used to pivot the sheet feeding and separating apparatus of FIG. 2.

Another important aspect of SFR, as employed in the present feeder, is its "minimum motion" characteristic. "Minimum motion" refers to the slight feed head pivoting motion when the SFR device is actuated. The $F_{sn}$ change is accomplished by rebalancing the pivoting feed head. The "minimum motion" aspect of the device is important since it reduces the time required for SFR to act. In cases where feed heads were moved from a stack of sheets in the past, the pivoting feed head motion was used to move the feed belt away from the sheets once a sheet had been fed. This required considerable cycle time. Feed head mass and extent of motion required were critical. The motionless approach of the present invention reduces cycle time requirements to a much smaller value. In this concept the rebalancing solenoid plunger 91 in FIG. 2A is in contact with a preloaded, low rate, close wound coil spring module 92. When the solenoid is actuated the plunger begins to move as soon as its magnetic field has adequately developed. The full feed head balancing force is available, i.e., the SFR function has been achieved, at this time. As the plunger continues to move to its home position very little change in the balancing, i.e., no functional change in $F_{sn}$, occurs due to the low spring rate of the spring module that includes spring 93.

The present paper feeder has dual modes of operation, i.e., in one mode, it acts as a stack force relief means to relieve the stack normal force and prevent multifeeds. In another mode, the feeder acts to increase the stack normal force in order to enhance sheet feeding and reduce misfeeds.

Figure 3A:
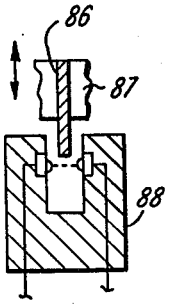
FIG. 3A is a partial side view of the photocell arrangement of the sensor shown in FIG. 3.
Figure 3:
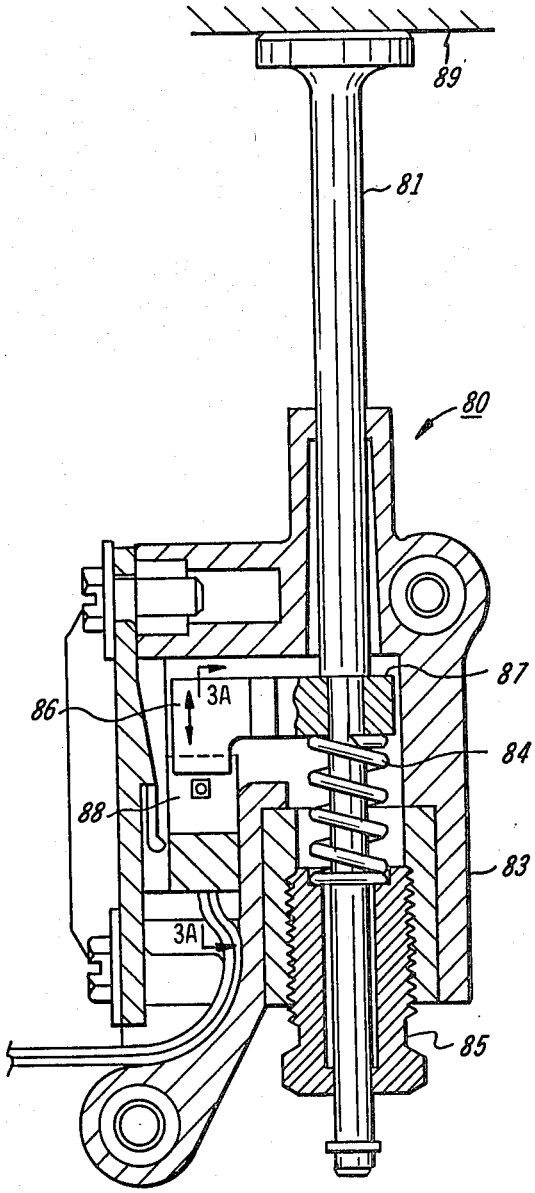
FIG. 3 is an elevational view of a stack force sensor used in the printing machine shown in FIG. 1.

When paper is inserted into either paper tray 34 or 36 and the access door is closed, a motor is actuated to raise paper stack 35 which is mounted on an elevator (not shown) until plunger 81 of sensor 80 contacts abutment 89. The sensor is adjusted such that the stack normal force of the idler and belt against the stack 35 is 0.5 lb. when the elevator motor is stopped. This stack height sensor combines smooth/frictionless linear motion with exacting positional control. The sensor comprises, as shown in FIG. 3A, housing 83 for a plunger 81 with drag forces on the plunger being controlled by clearances, part finish and material selection. The plunger 81 is in turn loaded by a compression spring 84 and is made adjustable by screw or bushing 85 which grounds the free end of the spring. The plunger has a flag 86 mounted on a shoulder 87 which as it moves in a line or direction, blocks and unblocks an optoelectrical sensor 88 as shown in FIG. 3*a*. This in turn signals the logic in controller 38 as to when the elevator tray must be indexed to maintain proper feeding. This sensor works in conjunction with stack force relief mechanism 70 to provide an automatic two step system of normal force adjustment for the friction retard feeders shown in FIG. 2.

In conclusion, it should now be apparent that a paper feeder is disclosed that enjoys a wide latitude in sheet feeding by the employment of stack normal force relief (SFR) that is characterized by reduction of the applied normal force to a stack to a lower level when paper is seen at a point that is about $\frac{1}{8}$ inch inside the feed, retard nip entrance. At that point, an optical sensor detects the sheet and alters a pivoting feed head assembly balance by applying an additional moment. The additonal moment is applied by a solenoid working through a low rate, preloaded spring module to the pivoting feed head assembly. When no paper is present at the sensor location, the stack normal force is reset to the previous level.

By using this approach, a dynamic stack normal force adequate to feed the most difficult sheets past the entrance guide can be applied to all sheets until the sheets are captured by the feed, retard nip. The reduced stack normal force also helps prevent multifeeding.

Key factors in keeping the response time required for SFR as small as possible are: (1) using a pre-loaded spring module between the solenoid case and the feed head. (2) Using a low rate spring. (3) Using a much shorter distance from the pivot point to solenoid action line than from the pivot point to stack normal force action line. These factors reduce response time by; (1) making the entire balancing force available as soon as solenoid core motion starts; (2) allowing very small core travel so as to achieve a reliable force output at the high end of solenoid capability; (3) making the minimum achievable static stack force with the device actuated close to zero and reducing the variation in SFR balance force with respect to elevator increment position being fed from. These contribute to accurate, repeatable balancing without head bounce and; (4) head mass is not a factor in response time.

What is claimed is:

1. A sheet feeding and separating apparatus adapted to feed and separate sheets individually from a stack of sheets, comprising in combination;

an endless belt mounted for sheet feeding engagement with an edge of the stack of sheets and applying a normal force thereto;

said feed belt being rotatably mounted between spaced roll supports to provide a deformable unsupported section therebetween;

a forward rotatable roll retard member having a supported curved frictional retard surface deformably engaging said feed belt in said unsupported section of said feed belt to form therewith a corresponding curved separating retard nip in which said retard surface and said feed belt are continuously biased against each other, said roll retard member having a greater diameter than either of said roll supports and including a drag brake located interiorly thereof, said drag brake being adapted such that single sheets passing through said retard nip will rotate and retard roll and multifeeds through said retard nip will cause said drag brake to inhibit rotation of said retard roll;

a guide means located between the stack of sheets and said retard nip for supporting and gating sheets fed from the stack said guide means including a frictional top surface and a beveled edge for breaking up and shingling slugs of sheets before they reach said retard nip;

stack force relief sensor means mounted in close proximity to said retard nip for signaling the presence or absence of a sheet in the vicinity of said retard nip;

a movably mounted frame member adapted to move about an off center pivot point, said frame member being adapted for supporting said feed belt, said retard member and said stack force relief sensor means;

stack height sensor means adapted to initiate movement of said stack toward said feed belt whenever the normal face of said feed belt against said stack of sheets is less than a predetermined amount; and actuator means for changing the normal force of said feed belt against said stack, said actuator means including a solenoid adapted to be actuated once a signal is received from said stack force relief sensor means to move said frame and reduce the normal force of said feed belt against said stack of sheets to a minimum value, said solenoid including a plunger with said plunger being coupled to said frame member by a low rate coil spring.

2. The apparatus of claim 1, wherein absent a signal from said sensor means said actuator causes said feed belt to assume its original engagement normal force against said stack of sheets in order to insure the feeding of a sheet to said retard nip.

* * * * *